US005171304A

United States Patent [19]

Ris et al.

[11] Patent Number: 5,171,304

[45] Date of Patent: Dec. 15, 1992

[54] FLEXIBLE SEALING MEMBER FOR INJECTION DEVICE

[75] Inventors: Jacobus Ris; Hendrik A. van Schoonhoven, both of Olst, Netherlands

[73] Assignee: Duphar International Research B.V., Weesp, Netherlands

[21] Appl. No.: 712,404

[22] Filed: Jun. 10, 1991

[30] Foreign Application Priority Data

Jun. 13, 1990 [EP] European Pat. Off. ..... 90201519.7

[51] Int. Cl.[5] ..... A61M 5/24

[52] U.S. Cl. ..... 604/200; 604/202; 215/358; 215/355

[58] Field of Search ..... 604/200–203, 604/236, 110; 215/358, 355, DIG. 3

[56] References Cited

U.S. PATENT DOCUMENTS

| | | | |
|---|---|---|---|
| 2,848,130 | 8/1958 | Jesnig | 215/31 |
| 3,450,135 | 6/1969 | Sarnoff | 604/206 X |
| 3,540,444 | 11/1970 | Moreland . | |
| 3,695,478 | 10/1972 | Sie et al. | 604/200 |
| 3,916,894 | 11/1975 | Cloyd | 604/203 |
| 4,072,149 | 2/1978 | Tischlinger | 604/202 |
| 4,291,695 | 9/1981 | Bekkoring et al. | 604/200 |
| 4,568,336 | 2/1986 | Cooper | 604/240 |
| 4,713,061 | 12/1987 | Tarello et al. | 604/200 |
| 4,976,925 | 12/1990 | Porcher et al. | 422/100 |

FOREIGN PATENT DOCUMENTS

| | | | |
|---|---|---|---|
| 1500009 | 9/1967 | France | 604/110 |
| 1203098 | 8/1970 | United Kingdom . | |
| 1318803 | 5/1973 | United Kingdom . | |
| 1449986 | 9/1976 | United Kingdom . | |

*Primary Examiner*—C. Fred Rosenbaum
*Assistant Examiner*—Mark O. Polutta
*Attorney, Agent, or Firm*—Stevens, Davis, Miller & Mosher

[57] ABSTRACT

The invention relates to a flexible sealing member for an injection device, comprising a neck which encloses a channel which is open at one end and is closed at the other end by a diaphragm and has an annular flange at its closed end for a clamping connection of the sealing member in the injection device. The diaphragm is at least substantially in the shape of a spherical cap, its convex outer surface being remote from the open end of the channel in the neck. The invention further relates to an injection device comprising this sealing member.

4 Claims, 3 Drawing Sheets

FLEXIBLE SEALING MEMBER FOR INJECTION DEVICE

BACKGROUND OF THE INVENTION

The invention relates to a flexible sealing member for an injection device, comprising a neck, enclosing a channel diaphragm and having an annular flange at its closed end for a clamping connection of the sealing member in the injection device.

Such a sealing member is disclosed in British Patent Specification 1,318,803 and can be used in an injection device to separate the injection liquid in the barrel of said injection device from the injection needle. It is known to effect the communication between the barrel and the injection needle by causing the diaphragm to burst as a result of the fluid pressure exerted on the diaphragm after actuation of the device. As a result of this communication, the injection liquid in the barrel can reach the injection needle and will be injected.

Such sealing members can be used not only in manually operated injection devices, e.g. in prefilled injection devices, but also in automatic injection devices or auto injectors, e.g. in an autoinjector as disclosed in British Patent Specification 1,449,986. In fact, automatic injection devices are also pre-filled with injection liquid; they are, however, intended for use by unqualified persons. For that purpose they are constructed so that the injection liquid can be administered automatically by a person not trained in giving injections. Consequently, automatic injection devices are designed first of all for use by persons who at a given instant, which is not known beforehand, have to administer an injection into their own body. These persons include, for example, soldiers after they have been exposed to an enemy warfare gas, such as, a nerve gas. However, many of the medicaments used in automatic injection devices show undesired side effects or are insufficiently or incompletely active in therapeutic dosages. Therefore, the activity of said medicaments if often made up with benzodiazepines, for example diazepam, which is known to have a muscle-relaxing activity. In addition to said therapeutic activity, diazepam also has a sedative effect, as a result of which the fighting value of the soldiers at the front is restored. For this latter purpose the soldier in the field is preferably provided with a separate automatic injection device which is filled with a liquid diazepam formulation. Such an injector is especially intended for appeasing a buddy in the battle field who has panicked as a result of war acts or injuries: that is "buddy aid".

It will be obvious from the above, that high requirements regarding reliability have to be imposed upon automatic injection devices. Such injectors are usually stored for many years at a time and, moreover, will be kept by the potential users for long periods of time under varying conditions. Despite these facts, the reliability of the injector must be sufficiently ensured at the critical instant when the injection is required. In fact, at said critical instant the user's life may depend on the ready operation of the injection device. Therefore, high demands should be made upon the mechanical properties of a sealing member having a centrally positioned diaphragm which bursts under pressure and then permits the injection liquid to reach the injection needle. It will be obvious that said diaphragm should retain its sealing function prior to use of the injection device, but should burst open at the proper instant to allow passage of the injection liquid. These properties of the diaphragm should last, even under extreme conditions which may occur upon use of the device. The authorities even require a proper functioning of the injection device in the temperature range from −10° C. up +50° C., to permit use of the device under both arctic and tropical conditions.

It has been found, however, that an automatic injection device, provided with a sealing member as disclosed in British Patent Specification 1,318,803 mentioned hereinbefore, does not meet this requirement, in that at a temperature of −10° C. the time required for ejecting the injection liquid is generally too long. The total time of ejection can be divided into the delay time, i.e. the time between actuation of the device and the start of liquid flow, and the real ejection time, i.e. the time between the start of liquid flow and the moment that said liquid flow has completely stopped. It has been observed, that in particular the delay time of this known injection device is completely unpredictable and varies between broad limits; therefore the "ejection-behavior" is not reproducible. This also applies when sealing members of bromobutyl rubber are used. This is the material of choice for injection devices comprising liquid diazepam formulations, as has been described in the non-prepublished European Patent Application no. 90200587.5 in the name of Applicants.

SUMMARY OF THE INVENTION

It is the object of the present invention to provide a flexible sealing member for an injection device as defined in the opening paragraph, in which the above disadvantages do not occur.

This object can be achieved by means of a sealing member, comprising a neck, enclosing a channel which is open at one end and is closed at the other end by a diaphragm and having an annular flange at its closed end for a clamping connection of the sealing member in the injection device, which sealing member is characterized according to the present invention in that the diaphragm is at least substantially in the shape of a spherical cap, its convex outer surface being remote from the open end of the channel in said neck.

It has been found surprisingly that by using the above sealing member of the invention in an injection device, in particular an automatic injection device, the above requirement is completely met. At low temperatures, e.g. at a temperature of −10° C., the injection liquid can be ejected with a considerably reduced delay time, providing a total ejection time within the required specifications. Moreover the "ejection-behavior" is completely reproducible in that injection devices provided with the sealing member of the invention function well within acceptable time limits at low temperatures. e.g. at −10° C., and thus can be used conveniently under arctic conditions.

The favorable properties of the sealing member of the invention are particularly prominent if the special shape of the diaphragm is combined with the shape of the flange as disclosed in British Patent Specification 1,318,803, mentioned hereinbefore, viz. having a substantially quadrangular cross-section, wherein both the front face and the rear face of said flange are acutely angled to the neck and extend in approximately the same direction, the outer edge of said front face projecting away from the neck. By using a sealing member with a flange as defined above, the diaphragm is prestretched during the clamping operation of the flange in the injection device. This prestretched condition of the diaphragm in the injection device guarantees an optimum "ejection-behavior" since after the bursting incident the flow aperture for the injection liquid can never be obstructed, so that the injection liquid behind the sealing stopper can then always freely reach the injection needle.

When using a sealing member provided with a flange as defined above, said sealing member of the present invention is in a preferred embodiment dimensioned in such manner that the front of the convex outer surface of the diaphragm projects forward from the neck over an at most substantially equal distance as the outer edge of the front face of the flange. This preferred embodiment of the sealing member of the invention is described in greater detail hereinafter.

The present invention further relates to an injection device comprising (i) a barrel which is open at each end, the forward end having a narrowed end portion with an adjoining outwardly extending flange, (ii) a needle holder for sealingly gripping an injection needle, said needle holder including a chamber and an outwardly extending flange part near the end of the chamber remote from the needle, and (iii) a flexible sealing member, comprising a neck with an outward annular flange to be accomodated in said injection device in such manner that the neck of the sealing member is inserted in the narrowed end portion of the barrel and that the flange of the sealing member is sealingly clamped between the flange of the barrel and the flange part of the needle holder. Said injection device is characterized in that a sealing member as defined hereinbefore is accomodated in the injection device in such manner that the convex outer surface of the diaphragm faces the injection needle.

BRIEF DESCRIPTION OF THE DRAWINGS

The invention will now be described in greater detail with reference to a preferred embodiment which is shown in the drawings, in which.

DESCRIPTION OF THE PREFERRED EMBODIMENTS

Figure 1:
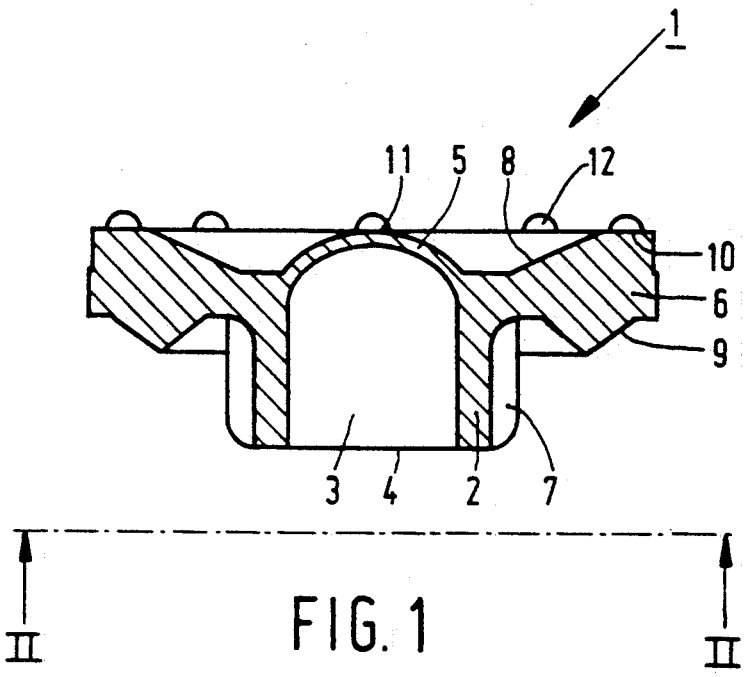
FIG. 1 is a cross sectional view of an embodiment of the sealing member according to the invention in a condition prior to accomodating said member in an injection device, taken on the line I—I of FIG. 2.
Figure 2:
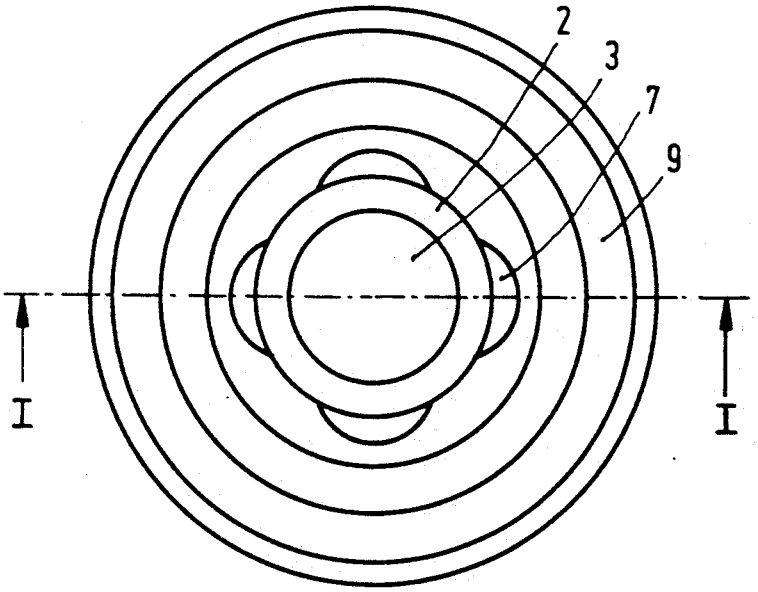
FIG. 2 shows the same sealing member viewed in the axial direction taken on the line II—II of FIG. 1.

The sealing member denoted with reference to numeral 1 comprises a neck 2, enclosing a channel 3 which is open at one end 4 and is closed at the other end by a diaphragm 5. The thin-walled diaphragm is in the form of a spherical cap; the convex outer surface of said cap is remote to the open end 4 of the channel. At its closed end the sealing member has an annular flange 6 for a clamping connection of the sealing member in an injection device shown in FIG. 3. The neck 2 is provided with four strengthening ribs 7. As will be obvious from FIG. 1, the annular flange has a substantially quadrangular cross-section, wherein both the front face 8 and the rear face 9 are acutely angled to the neck and extend in approximately the same direction. The outer edge 10 of said front face, provided with a plurality of anti-adhesion bumps 12, projects away from the neck. The front 11 of the convex outer surface of the diaphragm projects forward form the neck over a substantialy equal distance as the outer edge 10 of the front face of the flange, aside from said anti-adhesion bumps. Upon accomodation of the sealing member in an injection device, the diaphragm is prestretched when the annular flange 6 is clamped between a flange part of the needle holder of said injection device and a flange of the barrel of said device, exactly as described in British Patent Specification 1,318,803 mentioned hereinbefore.

The above-described sealing member is used in an automatic injection device as described in British Patent Specification 1,449,986, mentioned hereinbefore, and discussed below and compared with a sealing member as known from British patent Specification 1,318,803. At a temperature of −10° C. the total ejection time as well as the delay time, as defined above, are determined by actuating the injection device and measuring the time period up to the start of liquid flow and until the liquid flow has completely stopped. Fifty injection devices provided with sealing members as described above are compared with 50 equal devices, wherein known sealing members have been incorporated. For the injection devices according to the invention the average delay time at −10° C. determined as described above, is 0, the average ejection time is 1.66 sec. The variation (standard deviation) in ejection time is 0.33. Under the same conditions for the known injection devices an average delay time of 1.16 sec. is found, said delay time varying between 0 and 7.35 seconds. The total ejection time for these known devices is 3.05 with a variation (standard deviation) of 1.64.

Figure 3:
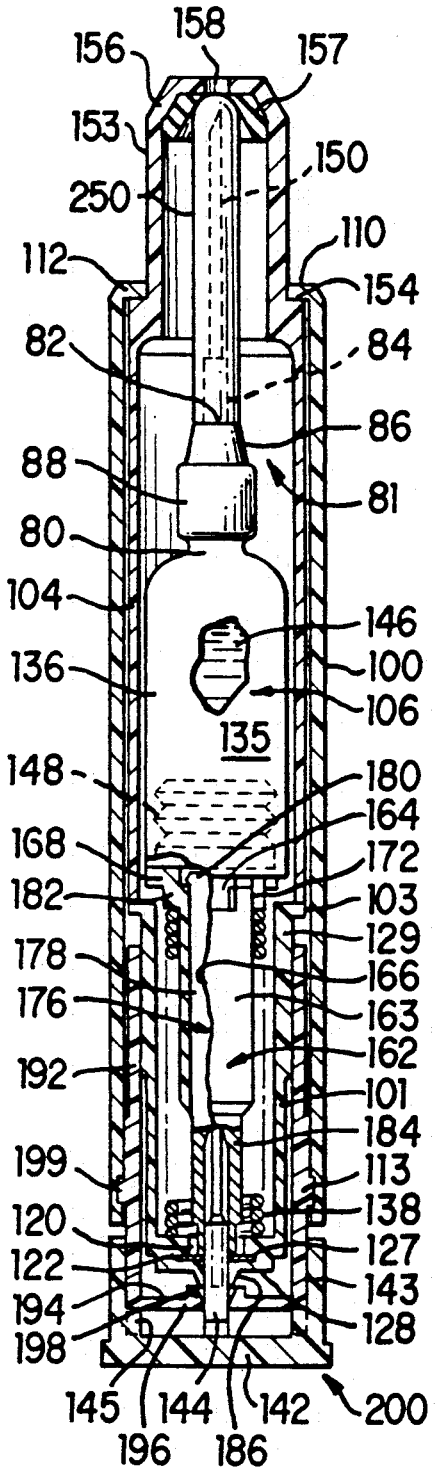
FIG. 3 (PRIOR ART)
FIGS. 3 and 4 show an automatic injection device according to GB 1,449,986 which can be employed in the present invention.

The automatic injection device of GB 1,449,986 is similar to that used in the present invention with the claimed flexible sealing member and is shown in FIG. 3. The diaphragm of the present invention is not shown in GB 1,449,986. GB 1,449,986 describes this automatic injection device, or hypodermic syringe, as follows:

In the following description of the "forward" and "rear" ends of the syringe and any of its components are to be understood as referring to the uppermost and lowermost ends, respectively, as viewed in FIG. 3.

The syringe comprises an outer cylindrical sleeve 100 having an inturned shoulder 110 at its forward end and an annular groove 113 in the inner wall adjacent its rear end. A cartridge assembly 106 is assembled in the shouldered end of the outer sleeve 100. The cartridge assembly 106 includes a cartridge 135 and a cartridge holder sleeve 104 fitted within the sleeve 100. Sleeve 104 has a decreased diameter end portion 153 forming a shoulder 154 which fits against seat 112 provided by outer sleeve shoulder 100. The extreme forward end portion 156 of the holder sleeve 104 is tapered and has a small circular aperture 158.

The cartridge 135 includes an ampoule cylinder 136 containing liquid medicament 146, a piston 148, and a cannula 150. The ampoule cylinder 136 has a necked portion 80 and terminates in an enlarged annular flange with a diameter less than that of the cylinder 136. The cannula 150 is secured to a cannula hub 81 which in turn is affixed to the enlarged flange on the necked portion 80. Cannula hub 81 comprises a reduced diameter portion 84, which is secured to cannula 150, and an intermediate body portion 86 connected to an enlarged body portion 88. The enlarged body portion 88 fits over and is secured to the annular flange of the necked portion 80 of the ampoule cylinder 136. Within the neck of the ampoule cylinder 136 between the rear end of the cannula 150 and the medicament, there may be interposed a fluid pressure rupturable diaphragm of the type described in GB Patent No. 1,203,098.

The cartridge assembly 106 is assembled in the outer sleeve 100 with the cannula 150 spaced from the apertured end of the holder 104. The overall length of the ampoule cylinder 136 and cannula 150 is such that the latter is contained within the holder sleeve 140, as illustrated in FIG. 3.

The outer sleeve 100 is of such length that it accommodates the cartridge assembly 106 in one (forward) end and receives a spring-loaded operating mechanism 200 in the other (rear) end to complete the device. The mechanism 200 comprises an inner sleeve 101 having an out-turned flange 103 at its forward end which abuts the rear end of the cartridge holder sleeve 104 when the mechanism is inserted in the outer sleeve 100. The rear end of the inner sleeve 101 is centrally apertured to form a hold 120. The rear outer face 122 of the inner sleeve 101 is planar and is perpendicular to the longitudinal axis of the sleeve for a purpose to be brought out later.

A plunger 162 fits within the forward end of inner sleeve 101. This plunger has a cylindrical body portion 163 and a circular head portion 164 of a diameter larger than the body portion 163 and generally slightly less than that of the position 148 in the ampoule cylinder 136. The hear 164 has an opening which is sized to align and correspond to a through hole 166 in the plunger body 163. The plunger head 164 is provided with a plurality of circumferentially spaced, radially extending tabs 168. These tabs 168 have an outer diameter greater than that of the plunger head 164 so that the tabs will engage the rear end of the ampoule cylinder 136. Longitudinal slots 172 are formed in the plunger head 164 immediately behind the tabs 168. These slots are sized so that they will accommodate the tabs 168 when the latter are later broken off or bent into the slots in operation of the device. These slots extend throughout the length of the head behind the tabs.

Figure 4:
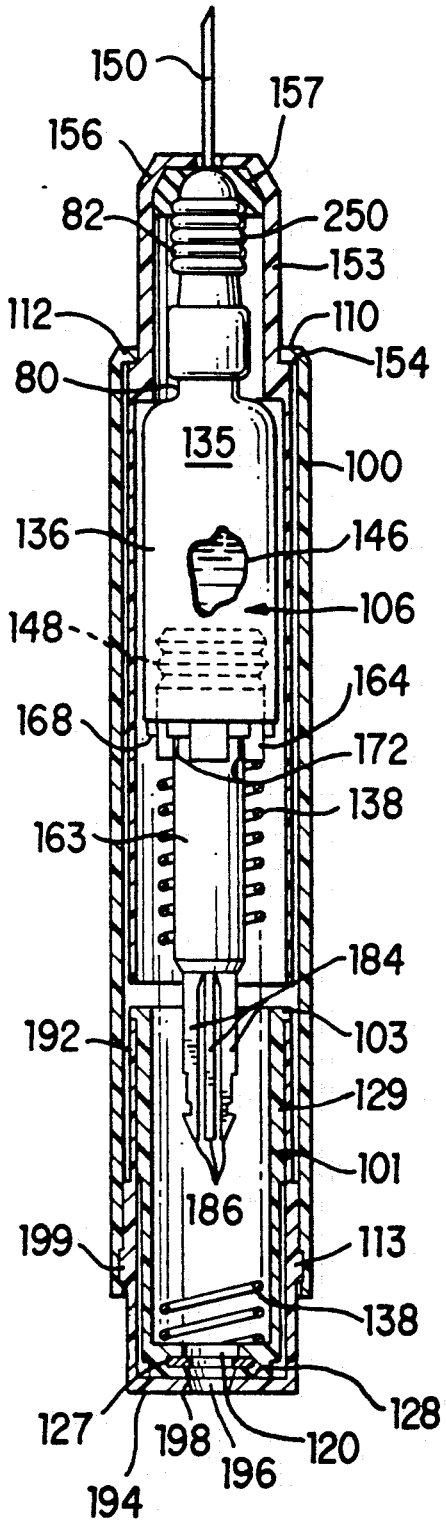
FIG. 4 (PRIOR ART)

Referring to FIGS. 3 and 4, a locking element 176 is fitted through the hole 166 in the plunger 162 and has a central body portion 178 with outwardly extending lugs 180 on the forward end engaging an annular shoulder 182 of the plunger head 164. The rear end of the locking detent 176 is provided with four equally spaced, longitudinally extending springy detent arms 184 terminating in frusto-conical detent heads 186. This locking detent 176 maintains the plunger 162 and inner gun sleeve 101 in assembled position with a soil spring 138 compressed therebetween as follows. The coil spring 138 is positioned over the plunger body 163 and abuts the plunger head 164 at its forward end and abuts the inner surface of the rear end wall of the inner sleeve 101 at the other. Upon compressing the coil spring 138 sufficiently, the detent heads 186 are cammed inwardly by engaging the periphery of the end wall opening 120 and pass therethrough whereupon the bases of the detent heads 186 come to rest on the rear planar face 122 of the inner sleeve 101 to retain the plunger and inner sleeve in assembled condition shown in FIG. 3 with the coil spring 138 compressed therebetween. When desired, the rear planar surface 122 of the inner sleeve 101 may be overlaid with a metal washer 127, in which case it is advantageous to provide a guide and holding flange 128 to surround the opening 120. The flange 128 is provided with a lip portion to retain the washer in place.

As illustrated in FIGS. 3 and 4, the inner sleeve 101 has a plurality of longitudinally extending raised ribs 129 running from the flange 103 approximately one-half the length of the said sleeve. An outer sleeve 192 fits over inner sleeve 101 and is of a diameter to frictionally engage ribs 129. The outer sleeve 192 has a rear end 194 with a central aperture 196 from which extends a frusto-conical cam surface 198 sized and shaped to cooperate with frusto-conical detent heads 186 to cam said heads radially inwardly. The outer sleeve 192 is provided with a circumferential locking rib 199 which fits in groove 113 in the outer sleeve 100 to retain the mechanism 200 in position in said outer sleeve. It should be noted that the length of outer sleeve 192 is slightly less than that of the inner sleeve 101 so as to make certain that there will be spaced between the forward end of the outer sleeve 192 and the flange 103 of the inner sleeve 101 so that the two sleeves may be moved relative to each other to cam frusto-conical detent heads 186 inwardly in operating the device.

In order to make certain that the frusto-conical detent heads 186 are not accidentally cammed inwardly, a safety assembly is provided. This safety assembly comprises a cap 142 having a cylindrical sleeve 142 sized to fit over the rear end portion of outer sleeve 192. A pin 144 extends inwardly from the center of the cap 142 through aperture 196 in outer sleeve 192 into the opening formed by the inner portions of the detent heads 186 to prevent inward movement of said detent heads. The cap 142 is provided internally with a plurality of spacer abutments 145 to assure proper positioning of the cap on the outer sleeve 192.

A sheath 250 of resilient material is positioned over the cannula 150 such that the open end of the sheath fits over and around cannula hub portion 84 and abuts the shoulder 82 formed by hub portions 84 and 86. The length of the sheath is such that its closed end is slightly beyond or spaced from the forward end of cannula 150. In order to make certain that the forward end of the sheathed cannula is maintained in proper alignment with aperture 158, a plurality of ribs 157 is formed on the inner surface of tapered holder portion 156 surrounding said aperture. Thus, the closed end of the sheath 150 is held in necessary alignment by bearing against the converging section of the ribs 157.

To use the syringe, which is designed for the self-administration of a medicament, the safety assembly is first removed by pulling off cap 142. The forward end of the syringe is then placed against a part of the body, e.g., the thigh, of the person using the syringe and the outer sleeve 100 is moved firmly in the forward direction. This causes the space between the forward end of the outer sleeve 192 and the flange 103 to close and, hence, the rear end face 122 of inner sleeve 101 approaches rear end 194 of outer sleeve 192. The sips of detent heads 186 enter the aperture 196 and the detent heads engage cam surface 198, which engagement moves the heads inwardly towards each other until a point is reached when the bases of the detent heads move clear of metal washer 127. Cartridge 135 is now moved rapidly forward under the action of compressed spring 138. The closed end of sheath 250 cannot move forward relative to sleeve 104 and so the forward end of cannula 150 pierces sheath 250. FIG. 4 shows the situation reached with the cartridge has been moved forward to its maximum extend but no medicament has been expelled from ampoule cylinder 106. As can be seen, cannula sheath 250 has been compressed during the forward motion and acts as a shock absorber to gradually absorb some of the energy provided by the power spring 138 as it drives the cartridge 135 forward. It should be noted that at no time, even when the cannula is fully extended, is the sheath compressed to such an extent that it would act as a solid and thereby provide no shock absorbance.

We claim:

1. A flexible sealing member for an injection device, comprising a neck having an annular flange and a diaphragm having a convex outer surface, said neck enclosing a channel which is open at one end and closed at the other end by said diaphragm, wherein said annular flange is at the closed end of the neck for a clamping connection of the sealing member in the injection device, wherein the diaphragm is at least substantially in the shape of a spherical cap, its convex outer surface being remote to the open end of the channel enclosed by said neck.

2. A sealing member as claimed in claim 1, wherein the annular flange has a substantially quadrangular cross-section, a front face and a rear face of said flange extending in substantially parallel directions and forming acute angles with the center line of the neck in the direction of the open end thereof, the outer edge of said front face projecting away from the neck, so that during the clamping operation of the flange in the injection device, the diaphragm is prestretched.

3. A sealing member as claimed in claim 2, wherein the front of the convex outer surface of the diaphragm projects forward from the neck at most a substantially equal distance as the outer edge of the front face of the flange.

4. An injection device, comprising (i) a barrel which is open at each end, the forward end having a narrowed end portion with an adjoining outwardly extending flange, (ii) a needle holder for sealingly gripping an injection needle, said needle holder including a chamber and an outwardly extending flange part near the end of the chamber remote to the needle, and (iii) a flexible sealing member as claimed in claim 1, 2 or 3, wherein the annular flange of the sealing member is to be accommodated in said injection device in such manner that the neck of the sealing member is inserted in the narrowed end portion of the barrel and that the annular flange of the sealing member is sealingly clamped between the flange of the barrel and the flange part of the needle holder, such that the sealing member is accommodated in the injection device in such manner that the convex outer surface of the diaphragm faces the injection needle.

* * * * *